US005316388A

United States Patent [19]

Caligiuri

[11] Patent Number: 5,316,388

[45] Date of Patent: May 31, 1994

[54] FOLDABLE BAG AND POUCH

[76] Inventor: Theodore L. Caligiuri, 436 Ardmore Ave., Hermosa Beach, Calif. 90254

[21] Appl. No.: 26,871

[22] Filed: Mar. 5, 1993

[51] Int. Cl.[5] ..... B65D 30/22; B65D 33/16

[52] U.S. Cl. ..... 383/127; 383/39; 383/40; 383/87; 383/4

[58] Field of Search ..... 383/4, 8, 37, 38, 39, 383/40, 80, 84, 86, 87, 127; 150/111, 112, 118, 119, 150, 152

[56] References Cited

U.S. PATENT DOCUMENTS

| | | | |
|---|---|---|---|
| 1,370,966 | 3/1921 | Hirsch | 383/4 X |
| 2,682,290 | 6/1954 | Ditlea | 383/4 X |
| 3,977,452 | 8/1976 | Wright | 383/87 X |
| 4,011,898 | 3/1977 | Hubbard | 383/4 X |
| 4,782,874 | 11/1988 | Chartier | 383/4 X |
| 5,009,516 | 4/1991 | Geeck | 383/4 X |

*Primary Examiner*—Allan N. Shoap
*Assistant Examiner*—Jes F. Pascua
*Attorney, Agent, or Firm*—J. E. Brunton

[57] ABSTRACT

A reusable bag which is readily closable so that food stuffs such as sandwiches and the like can be transported in a sanitary condition. When the bag is emptied it can be quickly and easily folded into a small, integrally formed pouch for compact storage until the time of reuse. The device is well suited for use as a lunch bag and can be quickly and conveniently folded inwardly of itself into a pouch provided on the bottom of the bag which is so compact that in its folded configuration the device can easily be carried in a pants pocket or in a lady's handbag. When in its folded configuration, the closure itself also provides a convenient handle for carrying the bag.

4 Claims, 6 Drawing Sheets

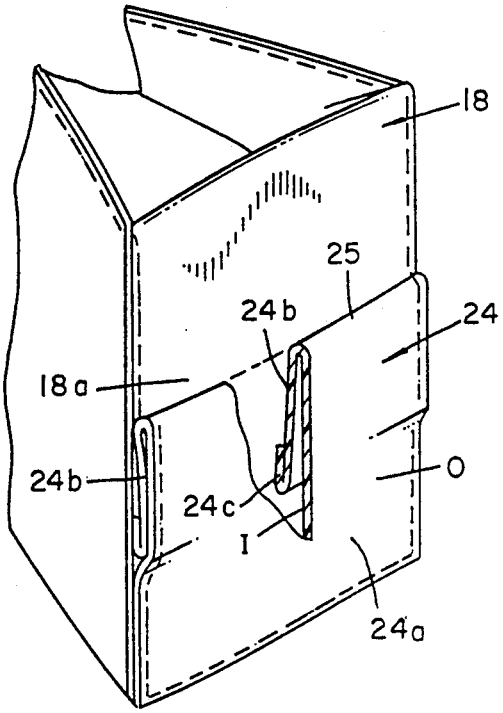
FIG. 9
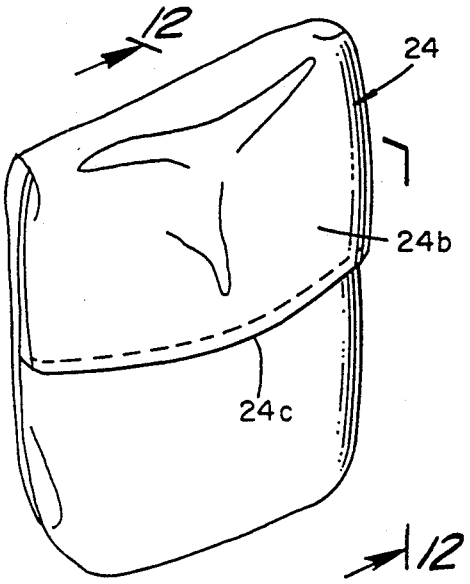
FIG. 11
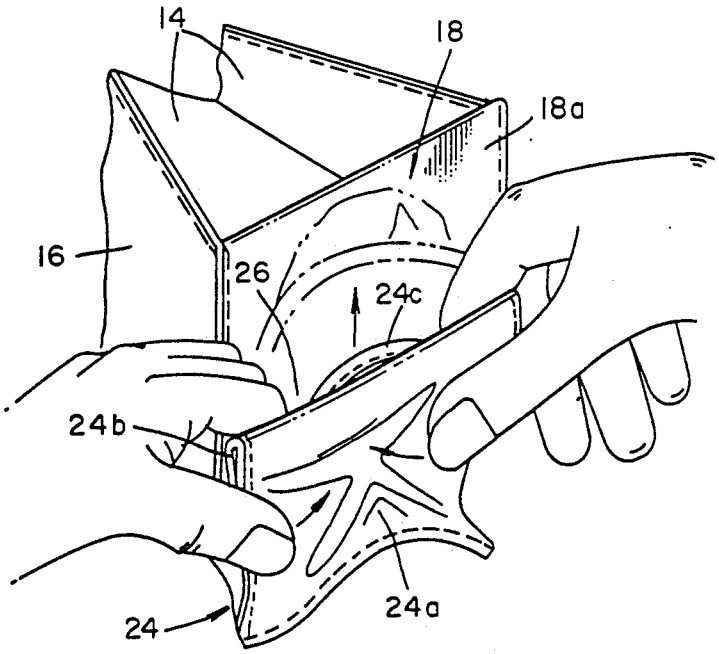
FIG. 10
FIG. 12
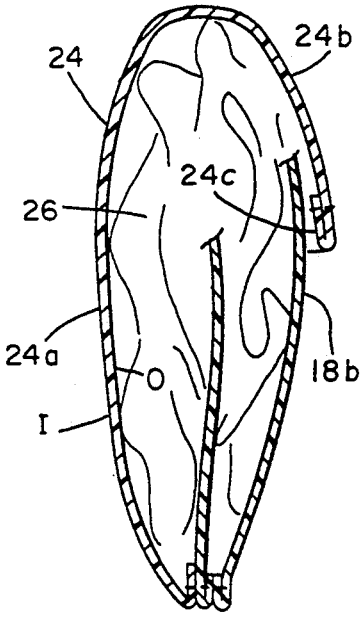

FOLDABLE BAG AND POUCH

BACKGROUND OF THE INVENTION

1. Field of the Invention

The present invention relates generally to foldable bags for carrying articles. More particularly, the invention concerns an easy-to-use foldable bag such as a lunch bag having an integral pouch into which the bag can be conveniently folded for transport and storage.

2. Discussion of the Invention

Various types of lunch and shopping bag configurations have been suggested in the past. Such prior art devices are typically fabricated from paper, plastic or cloth and can be discarded or folded in a loose manner for storage and subsequent use. Certain re-usable type prior art bags are constructed from a nylon material and are provided with fasteners of various types for closing the mouth of the bag. However, the bags, when closed, are difficult to carry and generally no provision is made for retaining the bag in a compact, folded storage configuration when it is not in use.

The carrying bag construction of the present invention provides substantial improvements over prior art shopping and lunch bags. More particularly, when not in use the bags can be tightly folded and conveniently stored within a small pouch that forms an integral part of the bag. The novel storage pouch is arranged so that the bag can be quickly and easily folded inwardly upon itself and inserted into the pouch to form an extremely compact construction that is readily receivable in a pants pocket or purse. Forming a part of the storage pouch is a closure panel which functions to securely close the pouch and to positively maintain the bag in its highly compact, folded transport and storage configuration.

In one form of the invention, a foldable bag, suitable for use as a lunch bag, includes novel closure means for use in closing the mouth of the bag so as to provide sanitary storage for foods such as sandwiches, fruit and the like. Uniquely, the closure also functions as a convenient handle for carrying the lunch bag from place to place. In its unfolded configuration, the bag is large enough to carry a number of articles including sandwiches and the like. However, when folded into its storage configuration, it can easily be transported even in a child's pants pocket.

SUMMARY OF THE INVENTION

A principal object of the present invention is to overcome the drawbacks of prior art reusable lunch bags by providing a reusable lunch bag which is readily closable so that food stuffs such as sandwiches can be transported in a sanitary condition and then, when emptied, can be easily foldable into a small, integrally formed pouch for compact storage until the time of reuse.

More particularly, it is an object of the invention to provide a lunch bag of the aforementioned character which can be quickly and conveniently folded inwardly of itself into a pouch provided on the bottom of the bag which is so compact that in its folded configuration the device can easily be carried in a pants pocket or in a lady's handbag.

It is another object of the invention to provide a device of the aforementioned character which provides the user with a readily apparent means for securely closing the mouth of the bag in one simple step without the use of fasteners of any type.

It is yet another object of the invention to provide a bag of the character described in the preceding paragraph in which the closure itself also provides a convenient handle for carrying the bag.

It is still another object of the invention to provide a bag and pouch of the class described which can take various geometric forms and can be constructed in various sizes and shapes.

It is still another object of the invention to provide a foldable bag for transport of articles of various sizes and shapes which is provided with convenient carrying handles.

Another object of the invention is to provide a foldable bag which is very strong and yet is constructed of compressible material which takes up a very small space when the bag is folded into the integrally formed pouch.

It is yet another object of the invention to provide a reusable shopping bag which is light weight, highly durable in use and inexpensive to manufacture in quantity.

BRIEF DESCRIPTION OF THE DRAWINGS

FIG. 9 is a fragmentary, generally perspective view of the bottom of the bag assembly partly broken away to show internal construction.

FIG. 10 is a fragmentary, illustrative, perspective view showing the initial folding of the bag into the pouch portion which is connected to the bottom wall of the bag.

FIG. 11 is a generally perspective view of the device as it appears after having been fully folded into the containing pouch formed on the bottom wall of the bag.

FIG. 12 is a cross-sectional view taken along lines 12—12 of FIG. 11.

DESCRIPTION OF THE INVENTION

Figure 1:
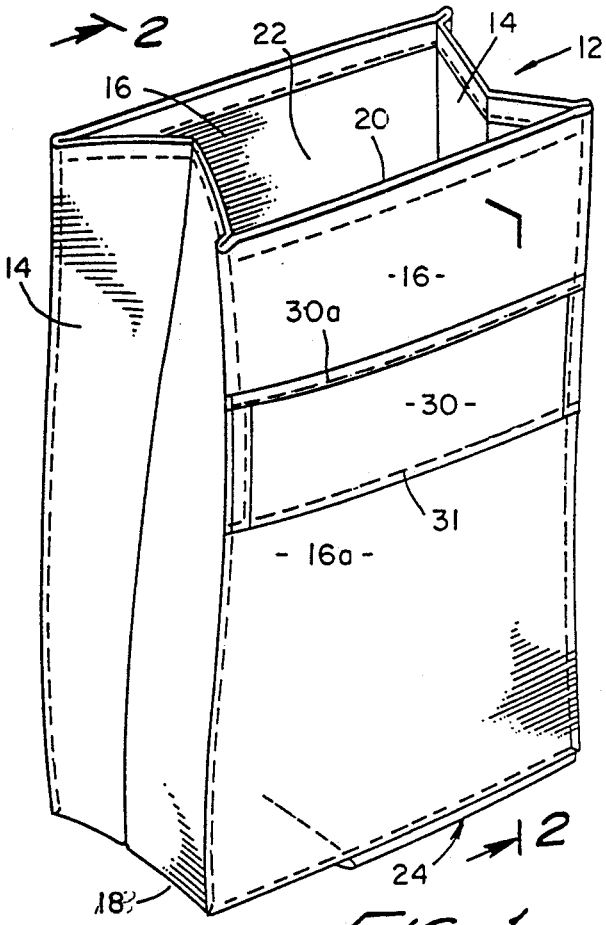
FIG. 1 is a generally perspective view of one form of the foldable bag of the invention.

Referring to the drawings and particularly FIGS. 1 through 5, one form of the foldable bag of the present invention is there illustrated and generally designated by the numeral 12. As indicated in FIG. 1, the bag in its unfolded configuration includes interconnected side end and bottom walls 14, 16 and 18 respectively. These walls, which are constructed from panels of flexible, readily foldable material such as nylon or cotton, define an article receiving enclosure 20 having a top opening 22. Article receiving enclosure 20 is of a first volume sufficient to receive articles of various configurations including food articles such as sandwiches, fruit, canned stuff and the like when the apparatus is used as a lunch bag. In a manner presently to be described, the interconnected side end and bottom walls are readily foldable from the first expanded configuration shown in FIG. 1 to a second tightly folded, highly compact configuration shown in FIGS. 11 and 12.

Figure 5:
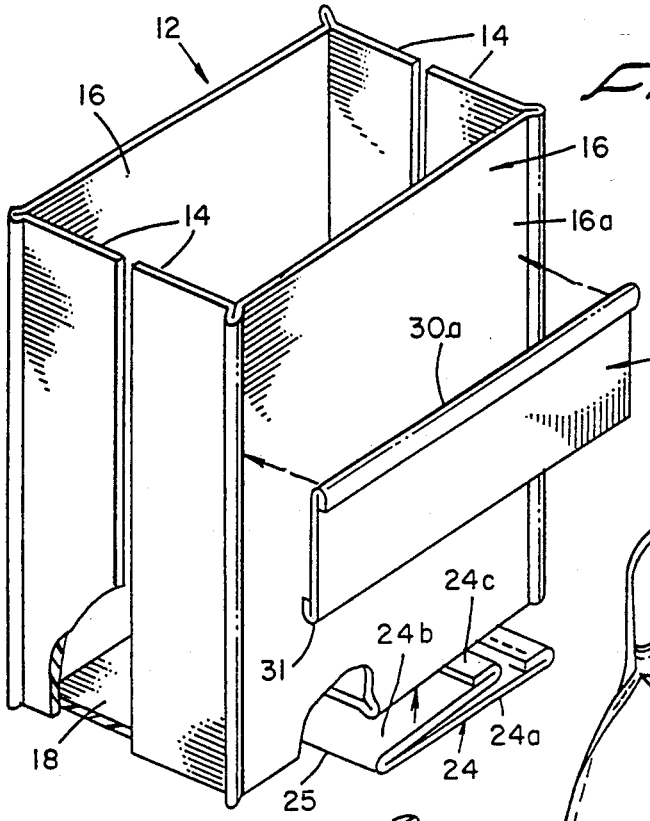
FIG. 5 is a generally perspective, exploded view of the bag construction illustrating the manner of interconnection of the component parts thereof.

As best seen in FIG. 5, a flexible panel 24 is connected to bottom wall 18 as by sewing and defines in cooperation with the bottom wall a storage enclosure or compartment 26 (FIG. 12) for receiving the side and end walls and a portion of the bottom wall in a tightly folded configuration (See also FIGS. 9, and 10). Storage enclosure 26 has a second volume which is substantially less than the first volume or the volume of the article receiving enclosure 20. As shown in FIGS. 5 and 9, flexible or second panel 24 comprises a first externally facing portion 24*a*, and inwardly folded portion 24*b* which terminates in a cuff portion 24*c*. Portions 24*a* and 24*b* are divided by a fold line 25. In a manner presently to be described, portion 24*b* of panel 24 forms a part of the closure means of this form of the invention for closing the storage enclosure 26 and for maintaining the side and end walls and a portion of the bottom wall of the bag in the tightly folded transport and storage configuration shown in FIG. 12.

Figure 2:
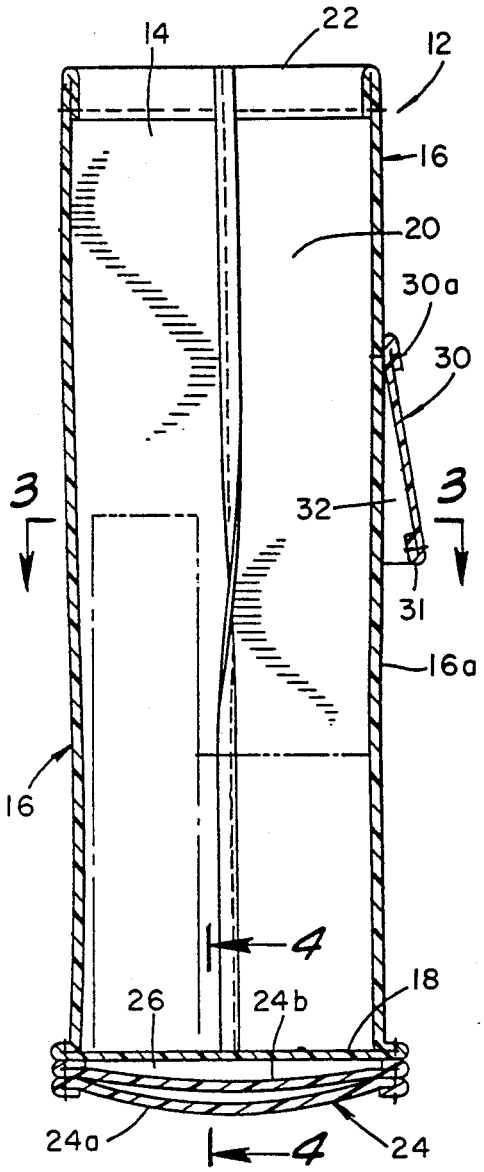
FIG. 2 is a cross-sectional view taken along lines 2—2 of FIG. 1.
Figure 3:
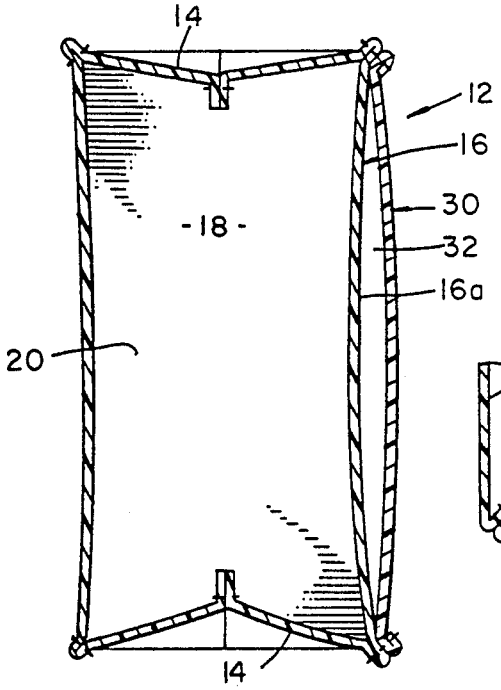
FIG. 3 is a cross-sectional view taken along lines 3—3 of FIG. 2.
Figure 4:
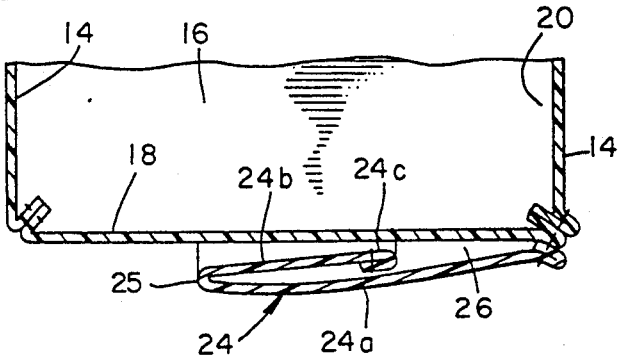
FIG. 4 is a cross-sectional view taken along lines 4—4 of FIG. 2.

Also forming an important feature of the foldable bag of the present embodiment of the invention is top closure means for closing the top opening 22 of the article receiving enclosure 20. As best seen in FIGS. 1 and 2, this top opening closure means is here provided as a flexible side or third panel 30 which affixed to the side wall designated in FIG. 2 by the numeral 16*a*. Panel 30 is connected to side wall 16*a* proximate upper edge 30*a* of the panel and the opposite edge thereof terminates in a cuff portion 31 (See also FIGS. 5 and 6). Panel 30 defines, in cooperation with side wall 16*a*, an enclosure 32 (FIG. 8) which is adapted to receive a portion of the side and end walls of the bag when they are folded the position shown in the phantom lines of FIG. 6 into the folded configuration shown by the solid lines of FIG. 6.

Figure 7:
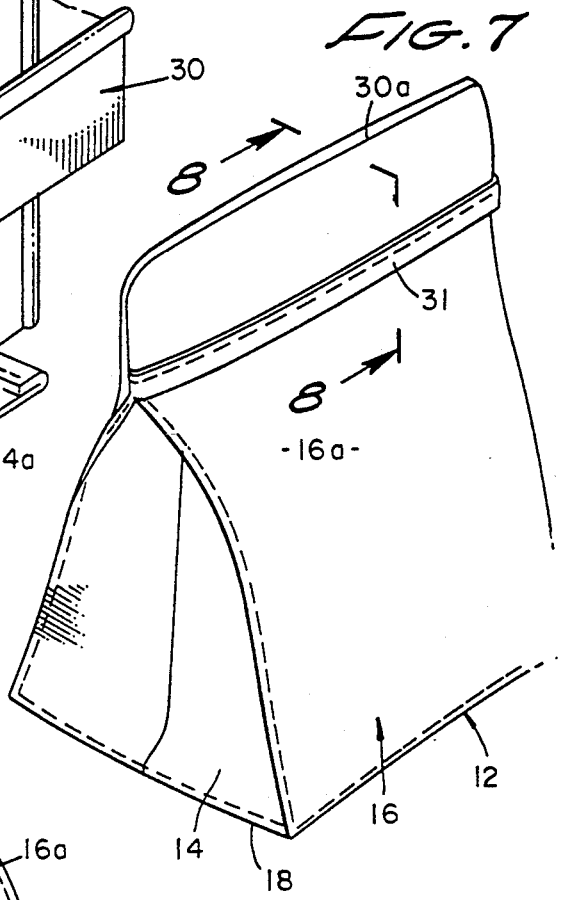
FIG. 7 is a generally perspective view illustrating the appearance of the container after the top portion has been closed and folded into a retaining pocket which also serves as a finger receiving means for conveniently carrying the closed bag.
Figure 6:
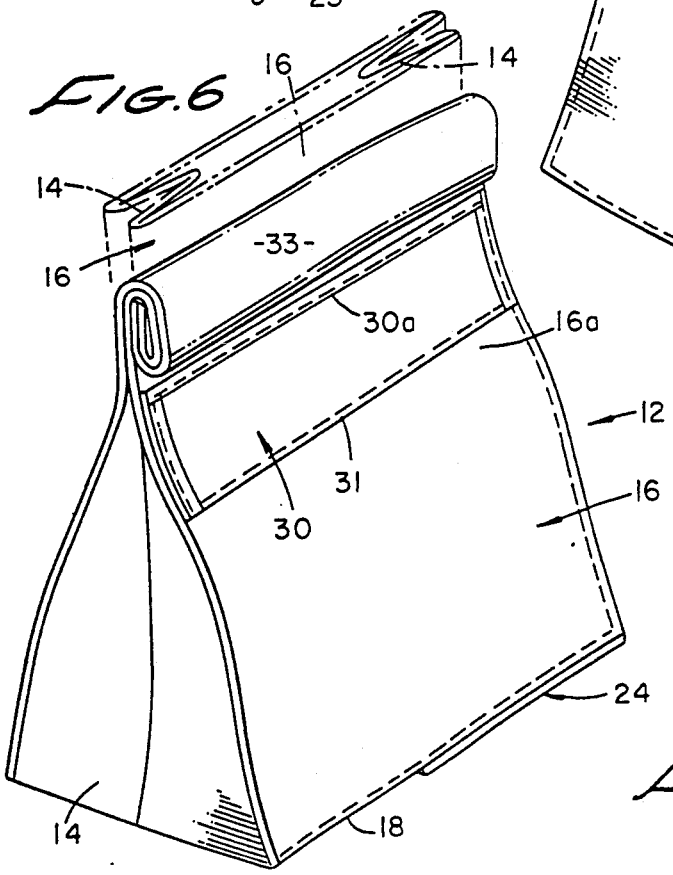
FIG. 6 is a generally perspective, illustrative view illustrating the first step in closing the open mouth of the bag.
Figure 8:
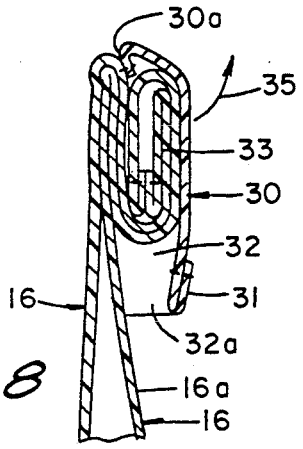
FIG. 8 is a cross-sectional view taken along lines 8—8 of FIG. 7.

Turning particularly to FIGS. 6, 7 and 8, the closure means of the invention for closing the top opening of the flexible bag not only functions to securely seal the opening of the bag as illustrated in FIGS. 7 and 8, but also uniquely functions as handle means for transporting the bag when in the top closed configuration as shown in FIG. 7. More particularly, by referring to FIG. 8, it is to be observed that when panel 30 is folded back upon itself in the manner shown in FIG. 8 with the folded top portion of the bag received within enclosure 32, the lower end of the enclosure 32*a* is open to receive the fingers of one hand of the user thereby enabling the closed container to be securely gripped with the fingers for transportation.

In closing the top open portion of the bag, the end and side walls are folded tightly against one another in the manner shown in FIG. 6. Panel 30 is then turned inside out in a manner so as to encompass the folded portions designated in FIG. 6 by the numeral 33. More particularly, it is to be noted that when the article is viewed in FIGS. 2 and 6, the cuff portion 31 is folded inwardly into engagement with wall 16*a*. However, upon reversing the panel 30 and folding it upwardly, over and around fold 33, the cuff portion 31 faces outwardly in the manner shown in FIG. 8. This reverse folding of panel 30 over and about fold 33 functions to securely encapsulate the folded portion 33 within enclosure 32 leaving the bottom portion 32*a* of the enclosure open to receive the fingers of the user while transporting the closed bag. In the folded configuration, the seam line 30*a* now resides at the top of the closed container in a manner best seen in FIGS. 7 and 8.

When it is desired to gain access to the article receiving enclosure 20, panel 30 is once again reversed by folding it upwardly in the direction of the arrow 35 in FIG. 8 so as to uncover folded portion 33. By unrolling the folded portion to the configuration shown in FIG. 2, access is once more readily gained to the article receiving enclosure 20.

After the articles have been removed from the foldable bag, as for example, after the user has finished eating the food stuffs which may be contained within the lunch bag, the bag can be quickly and easily folded into the highly compact folded configuration shown in FIGS. 11 and 12. When in this configuration, the entire device can be easily placed into a pants pocket or a lady's handbag for convenient storage and transport until it is once again time to use the device for transporting articles such as sandwiches or the like.

Turning to FIGS. 5, 9 and 10 through 12, it is to be noted that panel 24*a* is affixed to bottom wall 18 as by sewing along the inwardly folded cuff portion 24*b* of the panel (FIGS. 5 and 9). When it is desired to fold the bag into the folded transport configuration shown in FIGS. 11 and 12, the user first grasps the panel 24 in the manner shown in FIG. 10. The first movement in the folding operation is to turn the panel 24 inside out so that the inwardly folded portion 24*b* faces outwardly in the manner shown in FIG. 12. As the panel 24*b* is folded into its outward configuration, the bottom portion of the bag designated in FIG. 10 by the numeral 18*a* along with the side and end wall portions 14 and 16 are urged into the enclosure portion 26. By continually folding bottom portion 18*a* and side and end walls 14 and 16 inwardly, all of these portions can be made to reside within enclosure 26 in the manner shown in FIG. 12 so that portion 24*b* of panel 24 can be folded over the assemblage in the manner shown in FIG. 12 with panel 24*b* moving from the inwardly facing position shown in FIG. 9 to the outwardly facing position shown in FIGS. 11 and 12.

In the folded configuration, the second portion 18*b* of the bottom wall forms the outside front wall of the storage pouch while the under surface of panel 24, as viewed in FIG. 9 forms the rearward surface of the enclosure pouch as viewed in FIG. 12. More particularly, the surface of panel 24*a* designated in FIG. 9 as the outer surface 0 is turned inside out so that the inner surface designated in FIG. 9 by the letter I appears as the outer surface when the device is viewed in FIG. 12.

Figure 13:
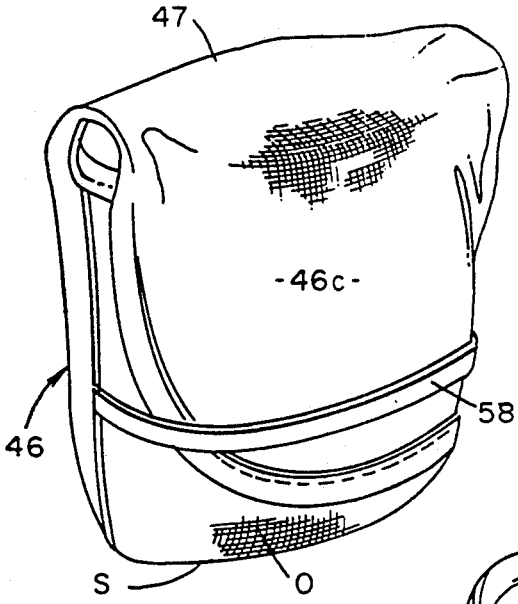
FIG. 13 is a generally perspective view of still another embodiment of the invention.

Turning now to FIGS. 13 through 21, another form of the foldable bag of the present invention is there illustrated. As best seen by initially referring to FIGS. 19, 20 and 21, the foldable bag of this embodiment of the invention comprises a first foldable panel 40 defining an article receiving enclosure 42 (FIG. 20) having an open top 44. A second oblong shaped foldable panel 46 is connected as by sewing to the side surface of the first panel 40 designated in FIG. 21 by the numeral 40I. Panel 40 defines in close cooperation with the 2nd panel a panel storage enclosure 48 (FIG. 14) for receiving first panel 40 in a tightly folded configuration. As indicated in the drawings storage enclosure 48 has a volume substantially less than the volume of the previously described article receiving enclosure 42. As illustrated in FIG. 13 closure means are provided for storage enclosure 42 and for maintaining first panel 40 in a tightly folded configuration therewithin in the manner shown in FIG. 14.

Figure 19:
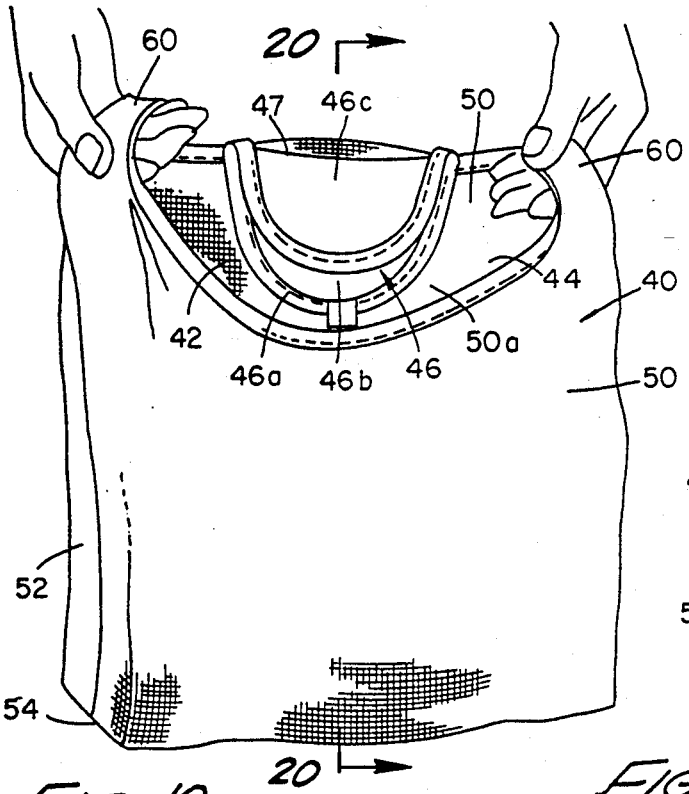
FIG. 19 is a generally perspective view of the device in a totally unfolded configuration to form a carrying bag having integral handle portions.
Figure 20:
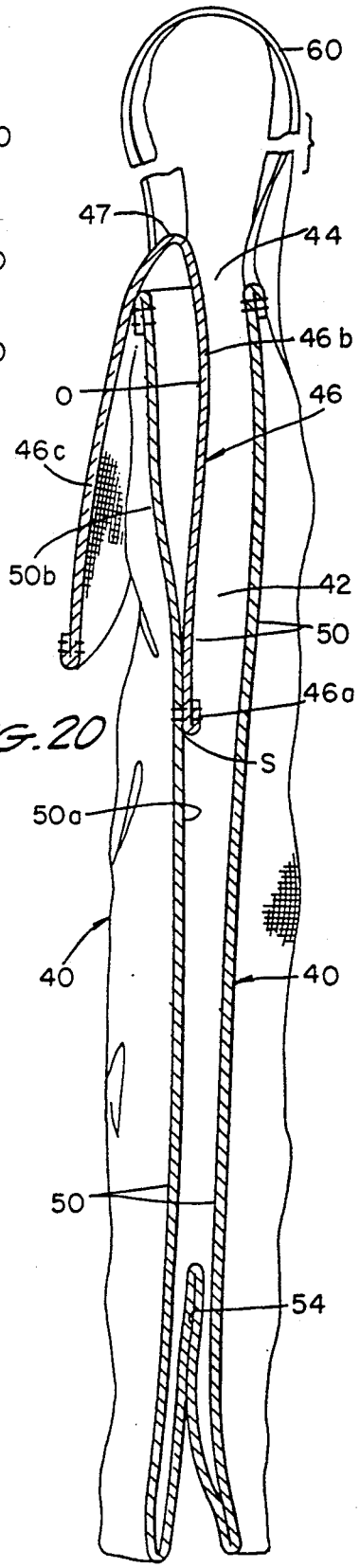
FIG. 20 is a cross-sectional view taken along lines 20—20 of FIG. 19.
Figure 21:
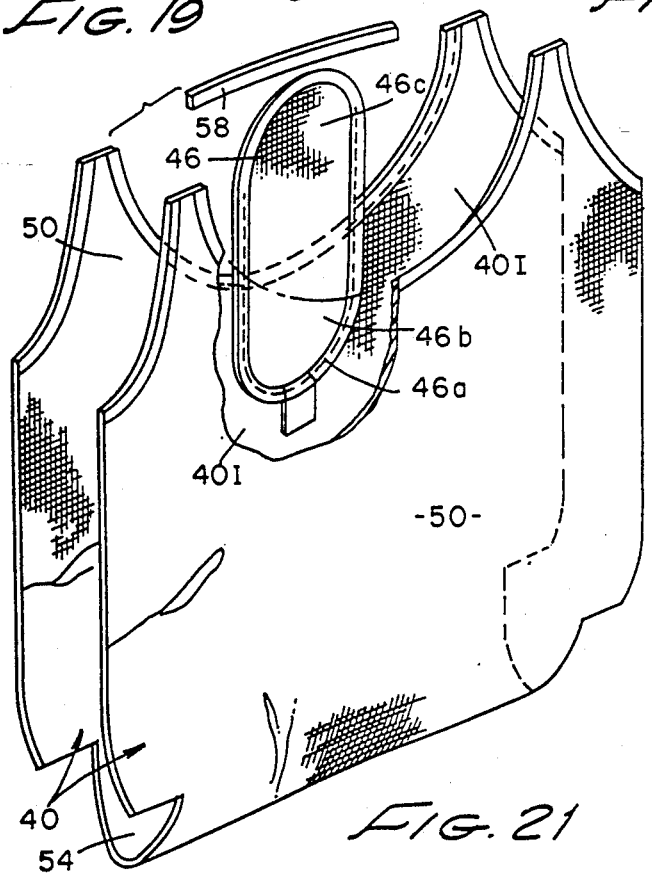
FIG. 21 is a generally perspective exploded view showing the device in its starting, unfolded, unsewn configuration.

The larger volume article receiving enclosure 42 of the device is defined by interconnected side, end and bottom walls 50, 52 and 54 respectively (FIG. 19). As best seen in FIG. 20, panel 46 is interconnected proximate its extremity 46*a* with the inner surface of side 50 which is designated in FIG. 20 as 50*a*. It is to be observed that panel 46 has a first portion 46*b* and a second integrally formed portion 46*c* by a fold line 47.

Figure 14:
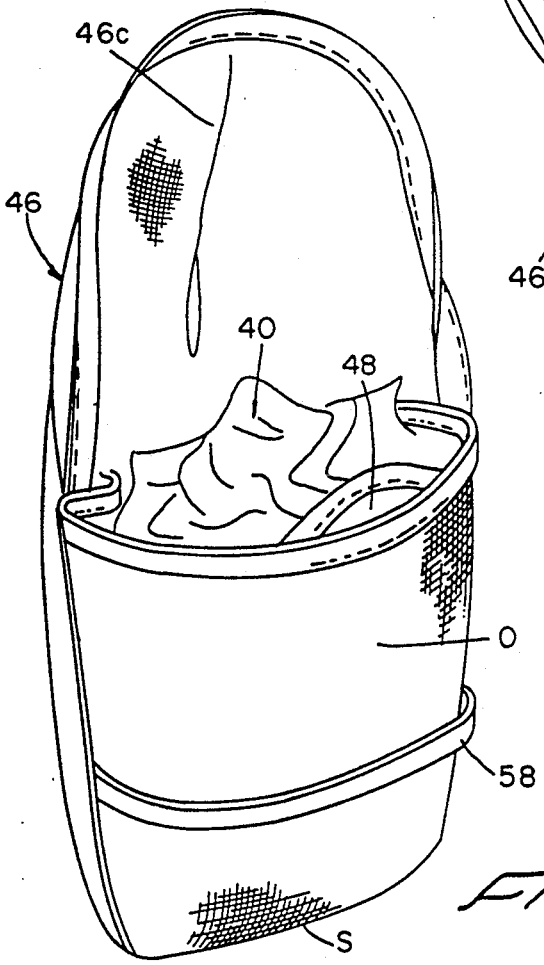
FIG. 14 is a generally perspective view of the embodiment of FIG. 13 showing the pouch portion in an open configuration.
Figure 15:
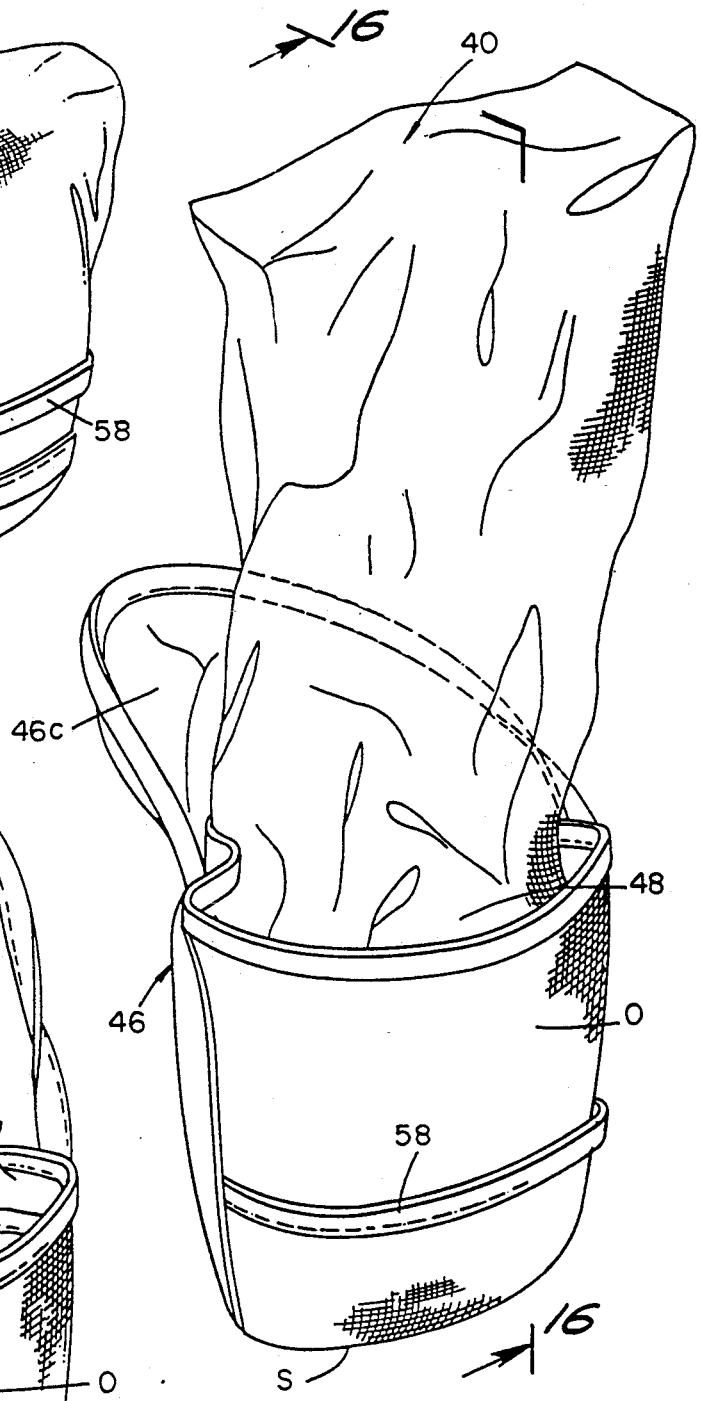
FIG. 15 is a generally perspective view similar to FIG. 14 but showing the foldable bag partially removed from the pouch.
Figure 16:
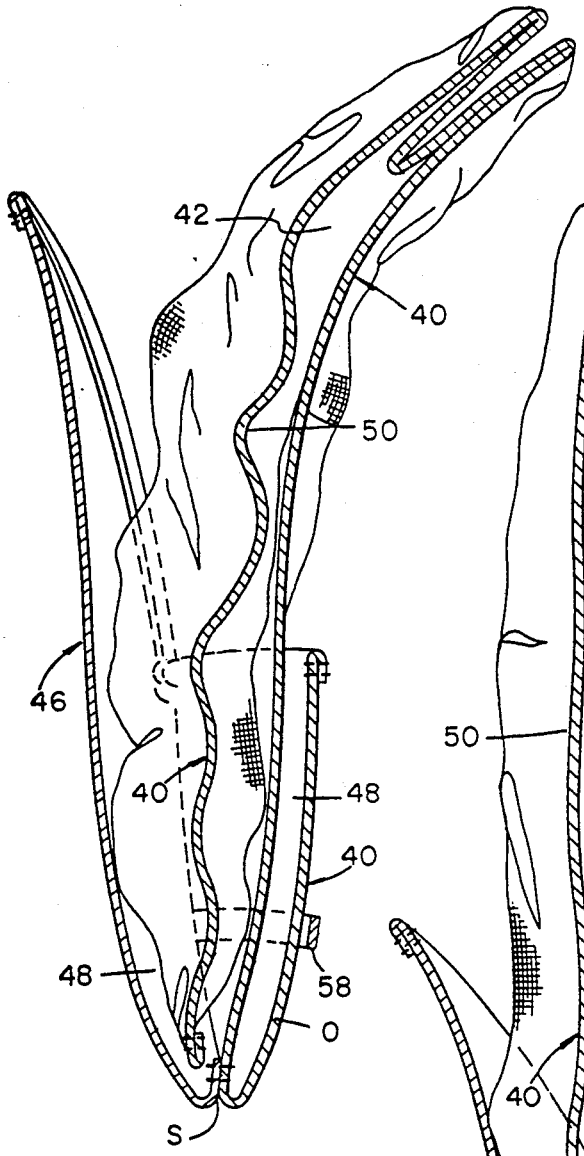
FIG. 16 is a cross-sectional view taken along lines 16—16 of FIG. 15.
Figure 17:
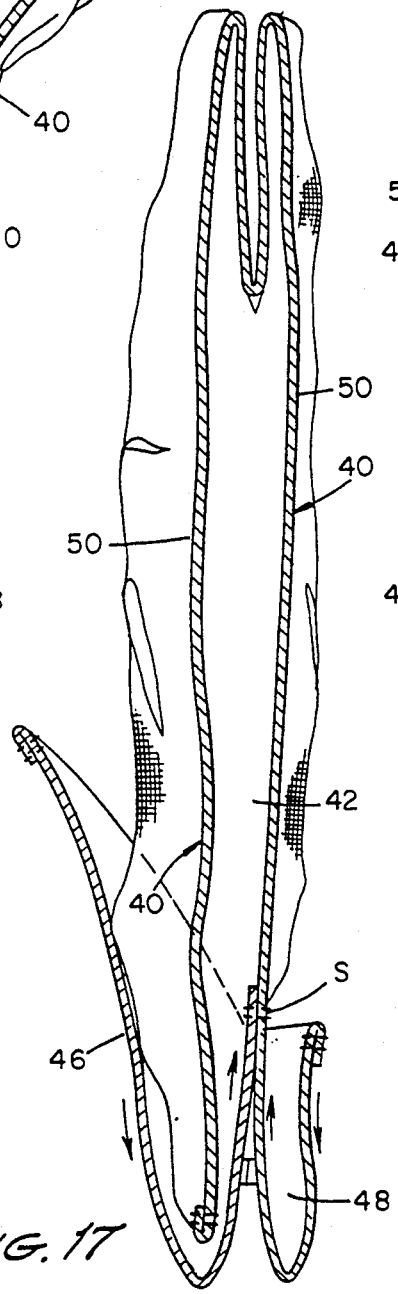
FIG. 17 is a cross-sectional view similar to FIG. 16 but showing further unfolding of the device.
Figure 18:
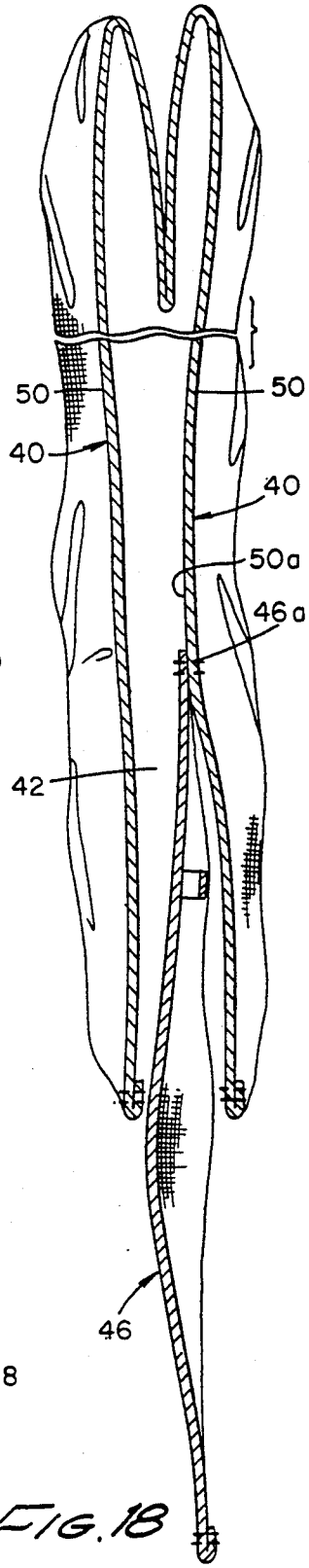
FIG. 18 is a cross-sectional view similar to FIG. 17 but showing still further unfolding of the device.

When the foldable bag is being used for carrying articles, portion 46*c* of panel 46 passes through opening 44 and drapes downwardly adjacent the rear surface 50*b* of panel 50. When the device of this form of the invention is used to store foldable panel 40 in the compact, tightly folded manner shown in FIGS. 13 and 14, portion 46*c* of panel 46 forms a part of the closure means of the invention for closing the storage enclosure 48 and for maintaining first panel 40 in its tightly folded configuration as shown in FIG. 14. Also forming a part of the closure means of this embodiment of the invention, is an elongated strap 58 which is connected proximate its ends to flexible panel 46 in the manner shown in FIGS. 13 and 14. When the bag is in the folded storage transport configuration, portion 46*c* of panel 46 is folded along fold line 47 and tucked beneath strap 58 in the manner best seen in FIG. 13.

To move the flexible bag from the storage transport configuration shown in FIG. 13 to the article transport configuration shown in FIG. 19, portion 46*c* of panel 46 is first removed from beneath strap 58 and is extended upwardly in the manner shown in FIG. 14. This exposes storage enclosure 48 and permits initial removal of folded panel 40 therefrom in the manner shown in FIGS. 15 and 16. When panel 40 is fully removed from storage enclosure 40, the pouch portion of the bag is turned inside out in the manner indicated by the arrows in FIG. 17 so that the outer forward surface of the pouch designated in FIGS. 13 and 14 by the letter O faces the inner surface of side wall 50*a* of the article receiving enclosure in the manner illustrated in FIG. 20. Similarly, the bottom seam designated by the letter S in FIG. 13 moves to a position within the article storage enclosure 42 designated by the letter S in FIG. 20.

When the bag is in the totally unfolded configuration shown in FIGS. 19 and 20, the bag may be conveniently carried by transversely spaced-apart handle portion 60 which form an integral part of panel 40.

After the articles being carried in the bag have been removed and the bag is to be returned to its storage and transport configuration shown in FIG. 13, back panel 58 is grasped proximate seam S and panel 46 is once again turned inside out so that the surface identified by the letter O in FIG. 20 becomes the outside front wall of the carrying pouch designated by the letter O in FIG. 13. In this position, the seam S has moved from the location interiorly of article storage enclosure 42 exteriorly to form the bottom outer seam of the pouch as designated by the letter S in FIG. 13. With the pouch thus formed by turning panel 46 inside out, the remainder of the flexible panel 40 can be tightly folded into storage enclosure 48. Portion 46*c* of panel 46 is then folded downwardly from the position shown in FIG. 14 to that shown in FIG. 13 and the panel is tucked beneath strap 58. The compact unit thus formed can then be placed in a purse or pants pocket for compact storage and transport.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A foldable bag for carrying articles comprising:
   (a) interconnected side, end and bottom walls defining an article receiving enclosure having a top opening and a first volume, said walls being foldable from a first expanded configuration into a second tightly folded configuration;
   (b) a flexible panel connected to said bottom wall for defining in cooperation therewith a storage enclosure for receiving said side and end walls and a portion of said bottom wall in a tightly folded configuration, said storage enclosure being of a second volume substantially smaller than said first volume;
   (c) closure means for closing said storage enclosure and for maintaining said side and end walls and a portion of said bottom wall in a tightly folded configuration; and
   (d) top opening closure means for closing said top opening of said article receiving enclosure, said means comprising a flexible side panel connected to one of said side walls.

2. A foldable bag as defined in claim 1 in which said flexible side panel defines in cooperation with said one of said side walls an enclosure for receiving a portion of said side and end walls in a folded configuration.

3. A foldable bag as defined in claim 1 in which said flexible side panel includes a bottom edge portion defining a bag carrying means for use in transporting said bag when said top opening is closed.

4. A foldable bag as defined in claim 1 in which said flexible panel connected to said bottom wall comprises first and second portions divided by a fold line, said second portion thereof comprising a portion of said closure means for closing said storage enclosure.

* * * * *